US011166564B2

(12) United States Patent
Simhan et al.

(10) Patent No.: US 11,166,564 B2
(45) Date of Patent: Nov. 9, 2021

(54) ERGONOMICALLY CONFIGURED MUSCLE RELEASE OFFICE CHAIR

(71) Applicant: Wisconsin Alumni Research Foundation, Madison, WI (US)

(72) Inventors: Shwetha Simhan, Whitefish Bay, WI (US); Manasi passi-Simhan, Whitefish Bay, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 0 days.

(21) Appl. No.: 16/202,907

(22) Filed: Nov. 28, 2018

(65) Prior Publication Data

US 2019/0159597 A1 May 30, 2019

Related U.S. Application Data

(60) Provisional application No. 62/591,393, filed on Nov. 28, 2017.

(51) Int. Cl.

| | |
|---|---|
| ***A47C 9/00*** | (2006.01) |
| ***A63B 21/04*** | (2006.01) |
| ***A63B 23/02*** | (2006.01) |
| ***A63B 21/02*** | (2006.01) |
| ***A63B 21/16*** | (2006.01) |
| *A47C 7/40* | (2006.01) |
| *A47C 7/42* | (2006.01) |
| *A47C 7/46* | (2006.01) |
| *A63B 23/00* | (2006.01) |

(52) U.S. Cl.

CPC ..... *A47C 9/002* (2013.01); *A63B 21/026* (2013.01); *A63B 21/04* (2013.01); *A63B 21/0442* (2013.01); *A63B 21/1609* (2015.10); *A63B 23/02* (2013.01); *A47C 7/402* (2013.01); *A47C 7/425* (2013.01); *A47C 7/462* (2013.01); *A63B 2023/006* (2013.01); *A63B 2208/0233* (2013.01)

(58) Field of Classification Search

USPC ..... 297/486

See application file for complete search history.

(56) References Cited

U.S. PATENT DOCUMENTS 3,262,716 A * 7/1966 Graham ..... B60R 21/02 280/751
3,713,694 A * 1/1973 Miller ..... B60R 21/02 297/486

(Continued)

FOREIGN PATENT DOCUMENTS

DE 3841688 A1 * 6/1990 ..... B60N 2/42763
WO WO-2018221299 A1 * 12/2018 ..... A61H 23/006

*Primary Examiner* — David E Allred

(74) *Attorney, Agent, or Firm* — Boyle Fredrickson S.C.

(57) ABSTRACT

An office chair that is ergonomically configured to allow for the coordination of stretches to the pectoralis minor muscle, trapezius muscle, and scalene muscles to open up the thoracic outlet, release muscle tension, and reinforce proper structure is provided. The stretches may be performed by an average human user while sitting in the office chair throughout the workday. The ergonomically configured chair assembly may have a brace supported by the seatback and extending downwardly therefrom over a left and right shoulder of the seated average human in a cantilevered fashion and an arm restraining device positioned rearward with respect to the rear face of the upstanding seat back.

16 Claims, 5 Drawing Sheets

(56) References Cited

U.S. PATENT DOCUMENTS

| | | | | |
|---|---|---|---|---|
| 3,829,158 | A * | 8/1974 | O'Connor | B60R 21/02 297/486 |
| 3,901,550 | A * | 8/1975 | Hamy | B60R 21/02 297/486 |
| 4,906,047 | A * | 3/1990 | Mikami | B60N 2/4221 297/464 |
| 5,456,519 | A | 10/1995 | Davis | |
| 5,542,746 | A | 8/1996 | Bujaryn | |
| 5,833,319 | A | 11/1998 | Davis | |
| 6,013,014 | A | 1/2000 | Hem | |
| 6,053,580 | A * | 4/2000 | White, Sr. | A61F 5/3784 297/467 |
| 6,312,366 | B1 * | 11/2001 | Prusick | A63B 23/0211 482/129 |
| 6,461,283 | B1 | 10/2002 | Maron | |
| 7,635,323 | B2 | 12/2009 | Halbridge | |
| 8,834,326 | B1 * | 9/2014 | Fulks | A63B 21/0608 482/140 |
| 9,480,340 | B1 * | 11/2016 | Harlow | A47C 7/543 |
| 10,646,051 | B1 * | 5/2020 | Koseff | A47C 31/126 |
| 2005/0009673 | A1 | 1/2005 | Harris | |
| 2008/0254955 | A1 | 10/2008 | Mongelluzo et al. | |
| 2010/0323861 | A1 | 12/2010 | Karwan | |
| 2011/0042431 | A1 * | 2/2011 | Bonnet | A45F 3/10 224/265 |
| 2014/0246888 | A1 * | 9/2014 | Renaudin | B60N 2/2806 297/250.1 |
| 2015/0375642 | A1 * | 12/2015 | Rajasingham | B60N 2/2848 280/38 |
| 2017/0007022 | A1 | 1/2017 | Battey et al. | |

* cited by examiner

ERGONOMICALLY CONFIGURED MUSCLE RELEASE OFFICE CHAIR

CROSS-REFERENCE TO RELATED APPLICATIONS

This application claims the benefit of U.S. Provisional Application No. 62/591,393, filed Nov. 28, 2018, hereby incorporated by reference.

BACKGROUND OF THE INVENTION

Postural dysfunction or poor posture occurs when the human spine is positioned in an unnatural state whereby the curves of the spine are emphasized, and thus, places the joints, muscles, and vertebrae in tense or overly stressed positions. Prolonged periods of poor posture may result in the buildup of pressure on these tissues, which over time may become difficult to reverse.

A major contributing factor of postural dysfunction is the prolonged periods of sitting that have become a routine part of many people's lives. For example, the average American sits an average of 13 hours a day, 10 of those hours occurring in front of a computer. Moreover, the use of smart phones and mobile electronics has contributed to poor posture even when users are not in a work environment. Normal thoracic kyphosis (or rounding of the back) is approximately 20-30 degrees forward whereas forward bend beyond this range is an exaggerated, unhealthy kyphosis.

Poor posture may result in upper and lower back, neck, shoulder and arm pain, lower limb pain including pain in the legs, hip, knees, and ankles, muscle fatigue, and associated headaches. Current treatments for these ailments include manual therapy and soft tissue massage, joint mobilization, physical therapy, dry needling, postural taping, electrotherapy, medication (e.g., Botox), and surgery. However, the outcome of these treatments is poor and often cannot reverse the harm done by the overwhelming amount of time that people spend reinforcing bad posture throughout the day.

One particular area affected by poor posture is the thoracic outlet, an anatomical space through which nerve bundles and arteries exit the neck and enter the arm. Postural dysfunction contributes to the narrowing of the thoracic outlet by tightening the surrounding muscles around the thoracic outlet such as the pectoralis minor muscle that crosses directly over nerve bundles, trapezius muscle of the upper back, and scalene muscle on the side of the neck. The condition in which there is compression of nerves and blood vessels through the thoracic outlet is known as thoracic outlet syndrome, which is aggregated by poor posture.

SUMMARY OF THE INVENTION

The present inventors have recognized that stretching and reinforcing proper posture throughout the day can help release muscle tension in key muscle groups contributing to postural dysfunction. Since most people spend most of the day sitting at a desk, it would be beneficial if these stretches could be performed throughout the day while sitting in an office chair.

Stretches aimed toward relieving compression in the thoracic cavity, reducing blood vessel and nerve impingement, and realigning the bones, muscles, ligaments, or tendons can help to alleviate the narrowing of the thoracic outlet. One stretch occurs through moving the shoulders posteriorly ("arching") to release the trapezius muscle and stretch the pectoralis minor muscle while keeping the center of the chest in a forward position. Another similar stretch occurs through placing the arms behind the back with the chest remaining forward such that the palms are facing rearward to release the trapezius muscle and stretch the scalene muscle.

The present invention provides an office chair that is ergonomically configured to allow for the coordination of stretches to the pectoralis minor muscle, trapezius muscle, and scalene muscles to open up the thoracic outlet, release muscle tension, and reinforce proper structure. These stretches may be performed by an average human user while sitting in the office chair and performed periodically throughout the workday.

In one embodiment, the present invention may be an ergonomically configured chair assembly adapted to support a seated average human thereon during muscle release stretches encompassing a seat having a horizontally extending seat surface adapted to support the seated average human; an upstanding seatback adjacent the seat with a support face adapted to support a back of the seated average human; a brace supported by the seatback and extending downwardly in a relaxed state over a front of the upstanding seatback space to provide downwardly cantilevered self-supporting brace arms positionable over a left and right shoulder of the seated average human and adapted to restrict forward movement of a front of a seated average human; and an arm restraining device positioned rearward with respect to the upstanding seat back to capture downwardly extending arms of the seated average human having his or her back by the upstanding seatback with arms extending behind the arm restraining devices to stretch the muscles of the seated average human.

It is thus a feature of at least one embodiment of the invention to allow for muscle stretching (as opposed to strength training) where the brace and arm restraining device places a predominantly rigid force on the chest and arm, respectively, of the user.

The brace arms may be downwardly positionable over the chest of the seated average human to engage the left and right pectoralis minor muscles of the seated average human.

It is thus a feature of at least one embodiment of the invention to stretch the shoulders backward to open the thoracic outlet.

The brace may provide no restraint at a chest centerline of the seated average human.

It is thus a feature of at least one embodiment of the invention that the brace not restrain the chest of the user to permit "arching" of the torso.

The brace arms may be resiliently biased to the relaxed state to allow the user to move the brace arms forward against increasing resistance.

It is thus a feature of at least one embodiment of the invention to allow a small amount of forward movement distinct from elastic forward movement.

The brace arms may extend downwardly less than half a length of a torso of the seated average human.

It is thus a feature of at least one embodiment of the invention to minimize the restraint on the user so as not to encumber the user while working.

The brace arms may be upwardly and downwardly adjustable to adjust for a shoulder height of the seated average human.

It is thus a feature of at least one embodiment of the invention to adjust the brace for different chair seatback heights and user heights.

The brace arms may be adjustable in left lateral and right lateral directions along the horizontal plane.

It is thus a feature of at least one embodiment of the invention to allow the user to mount and dismount the office chair and install the brace over their body.

The brace arms may be padded with a soft material.

It is thus a feature of at least one embodiment of the invention to provide comfort to the user when forward pressure is placed on the brace arms.

The arm restraining device may be at a downwardly extending angle with respect to a horizontal plane perpendicular to the vertical plane of the seat back. The downwardly extending angle may be no less than 20 degrees.

It is thus a feature of at least one embodiment of the invention to capture downwardly extending arms of the user at a natural angle of extension.

The arm restraining device may be a pair of armrests rotatable at a distal end about laterally separated horizontal axes. The pair of armrests may be rotatable about the horizontal axes in an upward or downward direction. The pair of rotatable armrests may also be rotatable in left lateral and right lateral directions.

It is thus a feature of at least one embodiment of the invention to support the user's forearms when the arms are extended behind the user.

The seat may have a raised portion extending between left and right sides of the seat and wherein a height of the raised portion is adjustable by the seated average human.

It is thus a feature of at least one embodiment of the invention to adjust the raised portion for users of different sizes and weights.

The seatback may be reclined no greater than 15 degrees.

It is thus a feature of at least one embodiment of the invention to encourage a seatback recline in the 10 to 15 degree range only where pressure on the spine and intervertebral discs are the lowest.

In one embodiment, the present invention may be an ergonomically configured chair assembly adapted to support a seated average human thereon during muscle release stretches encompassing a seat having a horizontally extending seat surface adapted to support the seated average human; an upstanding seatback adjacent the seat with a support face adapted to support a back of the seated average human; and a brace supported by the seatback and extending downwardly in a relaxed state over a front of the upstanding seatback space to provide downwardly cantilevered self-supporting brace arms positionable over a left and right shoulder of the seated average human and adapted to restrict forward movement of a front of a seated average human.

In one embodiment, the present invention may be an ergonomically configured chair assembly adapted to support a seated average human thereon during muscle release stretches encompassing a seat having a horizontally extending seat surface adapted to support the seated human; an upstanding seatback adjacent the seat with a support face adapted to support a back of the seated average human; and an arm restraining device supported positioned rearward with respect to the upstanding seat back to capture downwardly extending arms of the seated average human having his or her back supported by the upstanding seatback with arms extending behind the arm restraining devices to stretch the muscles of the seated average human.

These particular objects and advantages may apply to only some embodiments falling within the claims and thus do not define the scope of the invention.

DETAILED DESCRIPTION OF THE INVENTION

An "average human" referred to herein refers to human proportions based on averages from the Centers for Disease Control and Prevention's anthropometric reference data available at https://www.cdc.gov/nchs/data/series/sr_03/sr03_039.pdf.

Figure 1:
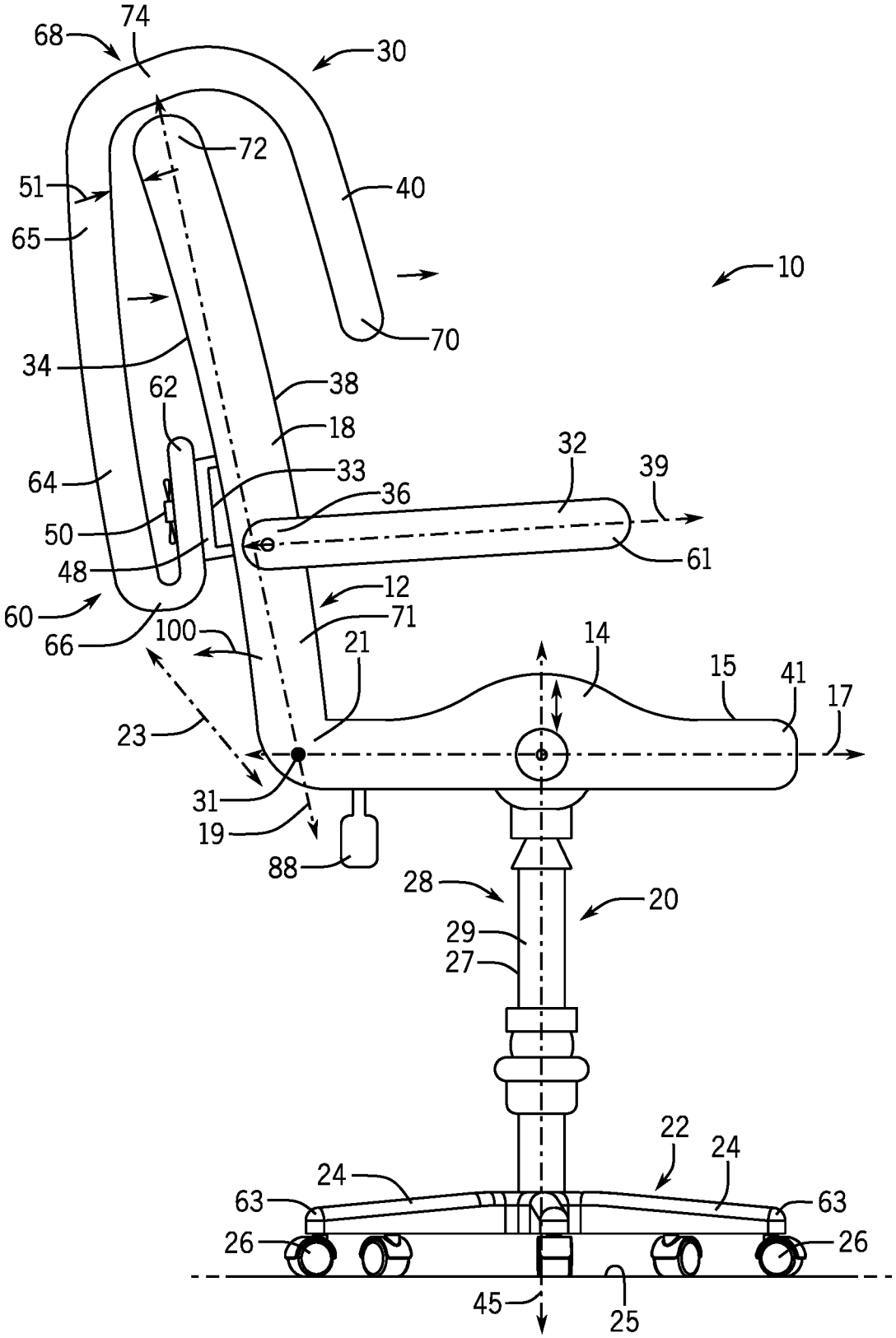
FIG. 1 is a side perspective view of an ergonomically configured office chair for muscle release according to one embodiment of the present invention, showing a cantilevered shoulder brace extending over a top of a seatback, a rearward extendable armrest, and a partially raised seat cushion.

Referring now to FIG. 1, a chair 10 may provide a seat assembly 12 having a seat pan 14 presenting an upper surface 15 extending generally along a horizontal plane 17 and on which a seated average human user 16 may sit. The seat pan 14 may provide a substantially planar upper surface 15 or a curved, concave upper surface 15 conforming to the curves of the lower body of the seated average human user 16.

Figure 9:
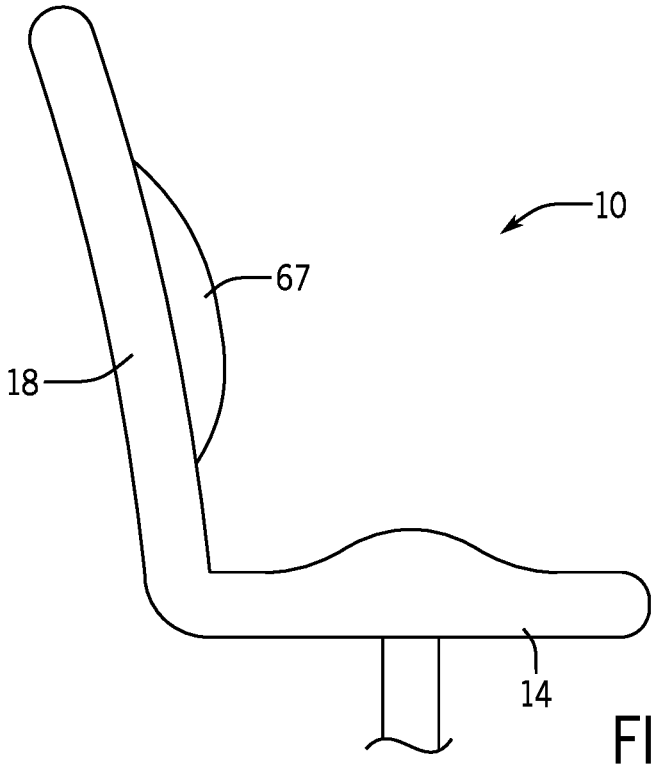
FIG. 9 is a side elevation view of the seatback of one embodiment of the present invention showing a lumbar support of the seatback.

A seatback 18 may extend upward generally along a vertical plane 19 from a rear 21 of the seat pan 14 to support the back of the seated average human user 16 thereagainst when seated. As seen in FIG. 9, the seatback 18 may include lumbar support 67 to help maintain posture and alignment of the lumbar spine. For example, the seatback 18 may be curved to follow the natural curvature of the spine to extend forward in the lumbar region and to retract below the lumbar region and at the upper shoulder region when an average human user 16 is seated.

A pivot axis 31 at a bottom edge 71 of the seatback 18 extending between left and right lateral sides of the seatback 18 may allow for reclining or rearward tilting of the seatback 18 at an angle 100 defined between a vertical plane 19 formed along a length of the seatback 18 when the seatback 18 is at an upright position, and an angle plane 23 formed along a length of the seatback 18 when the seatback 18 is at a reclined position. For example, the seatback 18 may be reclined an angle 100 between 0 and 20 degrees, substantially 10, or substantially 13 degrees rearward from the generally vertical plane 19. It may be desired to recline the seatback 18 between 10 and 15 degrees rearwards only from the generally vertical plane 19 to optimize the reduction in pressure on the inter-vertebral discs and sacroiliac joints in the seated average human user 16 when they are seated upright. In this manner, the seatback 18 may not be allowed recline past 15 or 10 degrees rearward from the generally vertical plane 19. Recline of the seatback 18 may occur with increasing resistance, for example, up to the 10 or 15 degrees of recline. The seatback 18 may also bend forward with increasing resistance, for example, up to the 10 or 15 degrees of forward bend.

Armrests 32 may be supported by the seatback 18 at a proximal end 36 and extend forward to a distal end 61 along a substantially horizontally plane 39 substantially parallel to the horizontal plane 17 of the seat pan 14 and toward a front 41 of the chair 10 along opposed left and right lateral side edges of the seat pan 14. As shown, the armrests 32 may be attached to the seatback 18 at a position above the seat pan 14 and extending at least 6 inches and as much as 20 inches to provide a broad surface supporting a bottom of the forearms of the seated average human user 16 when the upper arms of the seated average human user 16 are substantially vertical in an upright posture. As known in the art, the armrests 32 may be adjustable in multiple directions for the comfort of the seated average human user 16. For example, the armrests 32 may be adjustable upwards and downwards with respect to the seat pan 16 along vertical plane 19, forward and backward with respect to the seatback 18 along horizontal plane 39, and/or left lateral 73 and right 75 with respect to the seatback 18 along horizontal plane 39.

A lower surface of the seat pan 14 of the seat assembly 12 may be joined below by a seat frame 20 supporting the seat assembly 12 vertically above a lower horizontally extending ground surface 25 extending substantially parallel to horizontal plane 17. The seat frame 20 may provide a gas lift mechanism 28 for height adjustment of the seat pan 14 of the seat frame 20 along a substantially vertical axis 45 above the lower ground surface 25. The gas lift mechanism 28 may be attached and extend below a center of the seat pan 14 and include a telescoping gas cylinder 29 having a length extending and retracting along the vertical axis 45 and holding a gas that expands to increase the length of the gas cylinder 29 and compresses to decrease the length of the gas cylinder 29. For example, the seat pan 14 may be adjusted between a height of 12 and 24 inches above the ground surface 25 so that the seat pan 14 supports the upper legs of the seated average human user 16 evenly while the feet or lower legs of the seated average human user 16 rest comfortably on a lower surface such as the ground surface 25, footrest, or knee rest. The gas cylinder 29 may be surrounded by a cylinder cover 27 enshrouding the telescoping elements of the gas cylinder 29.

A lower end of the gas cylinder 29 of the seat frame 20 may be joined to a caster 22 having downwardly and outwardly extending spider arms 24 extending in a sprawled out configuration beneath the seat assembly 12 so that the seat assembly 12 may be supported above the ground surface 25 and may move along the ground surface by downwardly supported casters 26 supported at the distal ends 63 of the outwardly extending spider arms 24 and rolling over the ground surface 25.

It is contemplated that the seat assembly 12 may be supported above the ground surface 25 by an alternative assembly without casters, such as four standard legs extending downwardly from the four corners of the rectangular seat pan 14, a single pillar extending downwardly from a center of the seat pan 14, or a sled base providing two rectangular shaped wire frames extending downwardly along left and right side edges of the seat pan 14.

Figure 2:
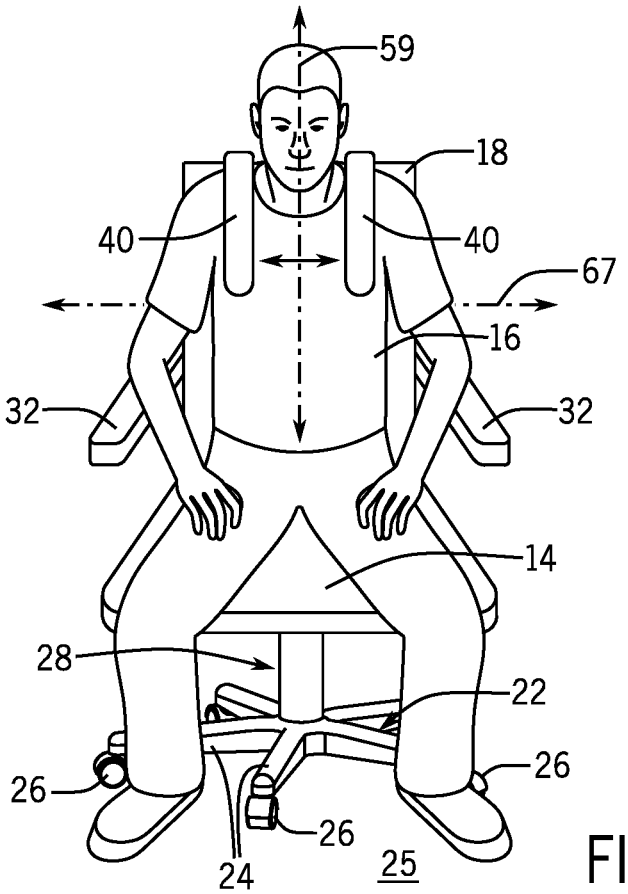
FIG. 2 is a front perspective view of an average human sitting in the muscle release office chair of FIG. 1 showing the cantilevered shoulder brace extending over the average human's left and right shoulder and positionable to engage the pectoralis minor muscles of the human.

Referring now to FIGS. 1 and 2, a rear face 34 of the seatback 18 is positioned generally parallel and opposite a support face 38 of the seatback 18 against which the seated average human user 16 rests their back in the seated position on the seat assembly 12. A shoulder brace assembly 30 having left and right lateral brace arms 40 may be attached to the rear face 34 of the seatback 18 and extended over the seatback 18 of the chair 10 to the front support face 34 of the chair 10.

Figure 3:
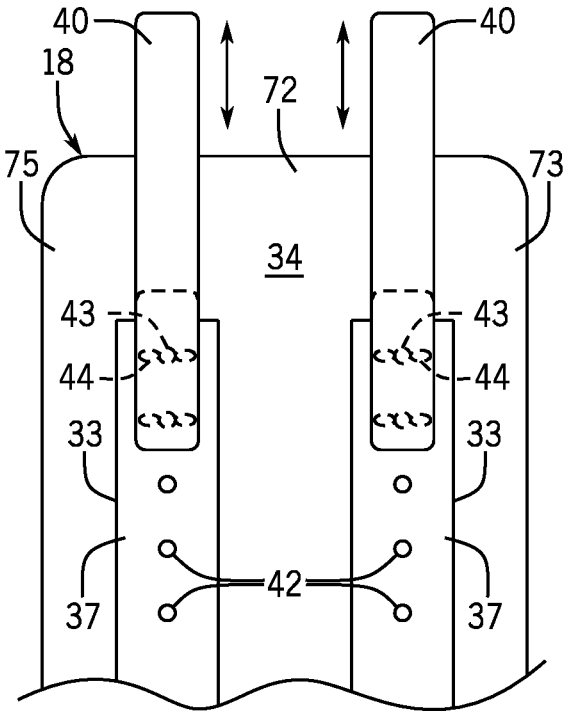
FIG. 3 is a rear elevation view of the seatback of one embodiment of the present invention showing the cantilevered shoulder braces being upwardly and downwardly adjustable to adjust for a height of the average human's shoulders.
Figure 4:
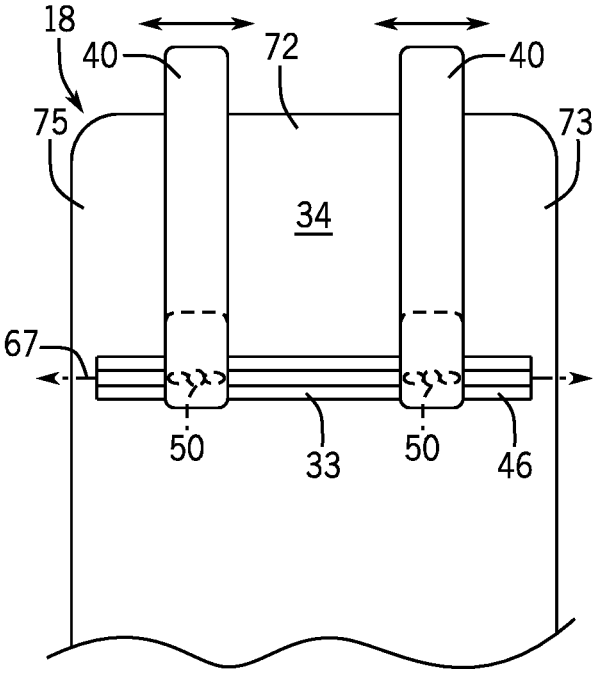
FIG. 4 is a rear elevation view of the seatback of the muscle release office chair of FIG. 1 showing the cantilevered shoulder braces being laterally slidable to assist the human in putting on the cantilevered shoulder brace.
Figure 5:
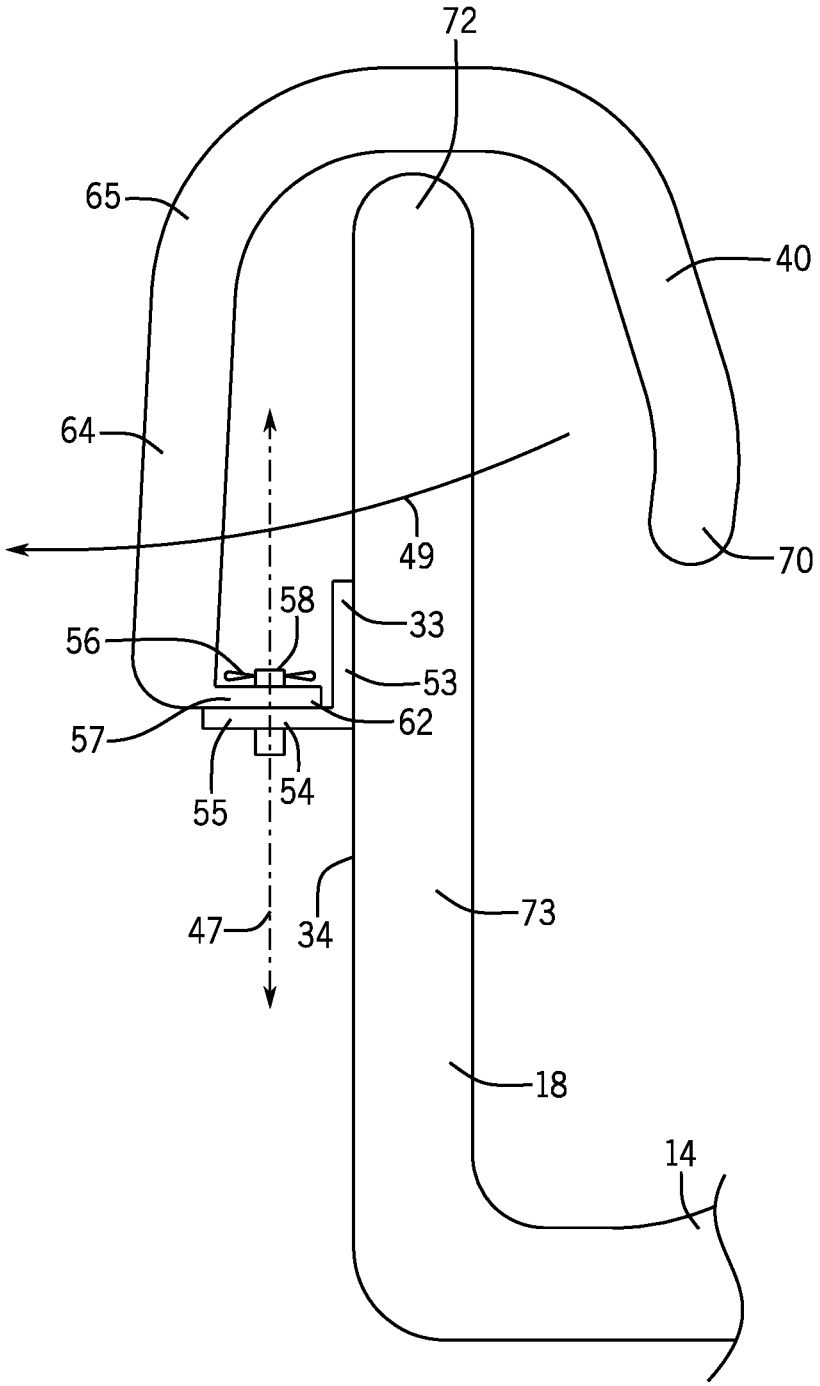
FIG. 5 is a side elevation view of the seatback of one embodiment of the present invention showing the cantilevered shoulder braces being laterally swingable to assist the average human in putting on the cantilevered shoulder brace.

Referring now to FIGS. 3, 4, and 5, a bracket 33 of the shoulder brace assembly 30 may facilitating attachment of the brace arms 40 to the seatback 18 of the chair 10. The bracket 33 may also provide relative movement of the brace arms 40 with respect to the seatback 18 for positional adjustment as further described below.

In one embodiment of the present invention, shown in FIG. 3, the bracket 33 may be left and right longitudinal rails 37 attached to the rear face 34 of the seatback 18 and extending between a top 72 and bottom 71 of the seatback 18 to provide for height adjustment of the left and right brace arms 40, respectively. The rails 37 may include a plurality of equally spaced threaded holes 42 positioned between the top 72 and bottom 71 of the seatback 18 permitting holes 43 of a distal end 62 of the brace arms 40 to align with the threaded rail holes 42 at a desired height of the seatback 18 providing a desired position of the brace arms 40 with respect to the seatback 18. A distal end of the brace arms 40 may include a pair of correspondingly spaced holes 43 aligning with any two holes 42 of the rails 37, and the two sets of holes 42, 43 receiving lock bolts 44 therein for coupling of the brace arms 40 to the rails 37.

It is contemplated that an alternative bracket 33 may include rails 37 acting as a slide (similar to rail 46 described below) or locking ratchet mechanism known in the art to provide height adjustment of the brace arms 20 between the top and bottom of the seatback 18 instead of alignment of holes 42 of the rails 37 as described above.

It is understood that the position of the brace arms 40 with respect to the top 72 and bottom 71 of the seatback 18 may be adjusted by the bracket 33 to accommodate a shoulder height of the seated average human user 16 such that the brace arms 40 extend over the height of the shoulders of the seated average human user 16 while the user is sitting upright within the chair 10 with proper posture.

In another embodiment of the present invention, shown in FIGS. 1 and 4, the bracket 33 may be a single rail 46 attached to the rear face 34 of the seatback 18 and extending between a left lateral 73 and right lateral 75 side of the seatback 18 to provide for lateral adjustment of the brace arms 40 between left lateral 73 and right lateral 75 sides of the seatback 18. The rail 46 may be, for example, a steel plate being held by clamps 48 of the distal end 62 of the brace arms 40 permitting horizontal left and right movement of the brace arms 40 along a length of the rail 46. The clamps 48 of the brace arms 40 may be fixed in position by a lock bolt 50 horizontally received in the clamps 48 so that the clamps 48 may be tightened to press the arms 40 against an opposed rail 46 surface immobilizing it.

It is understood that the lateral position of the brace arms 40 may be adjusted to position them inwardly over the pectoralis minor muscles of the seated average human user 16 and sliding them outwardly toward the lateral left and right sides of the seatback 18 and displaced from the front of the chair 10 when the seated average human user 16 is mounting or dismounting the chair 10.

In another embodiment of the present invention, shown in FIG. 5, the bracket 33 may provide a swing pivot 52 attached to a rear face 34 of the seatback 18 and rotating the brace arms 40 along a curve 49 with respect to an axis of rotation 47 formed by the swing pivot 52. The bracket 33 may be an "L" shaped metal plate 35 having a first face 53 attached to the rear face 34 of the seatback 18 and a perpendicular second face 55 extending from a bottom of the first face 53 and including a vertically extending hole 54 therein. The vertically extending hole 54 aligns with a vertically extending hole 56 of a horizontally extending flange 57 of the distal end 62 of the brace arms 40 permitting a lock bolt 58 to be vertically received therethrough to define an axis of rotation 47 of the swing pivot 52.

The swing pivot 52 allows for swinging rotation of the brace arms 40 along the curve 49 from a forward position whereby the brace arms 40 extend downwardly along a front of the seated average human user 16 to a lateral position whereby the brace arms 40 are on the left 73 or right 75 lateral side of the seatback 18 or to a rear word position whereby the brace arms 40 are behind the seatback 18. The arms 40 may swing through a central angle between 0 and 90 or 180 degrees. In one embodiment, the swing pivot 52 may be coupled or hinged together such that the arms 40 move together in tandem, for example, swinging inward together or outward together at about the same angle.

It is understood that the brace arms 40 may be swung inward along the curve 49 to a forward position whereby the arms 40 are in front of the pectoralis minor muscles of the seated average human user 16 and swung outward along the curve 49 to a lateral position displaced from the front of the chair 10 to facilitate the seated average human user 16 mounting or dismounting the chair 10.

It is understood that the bracket 33 may be attached to the rear face 34 of the seatback 18 anywhere along a vertical height of the seatback 18. For example, it may be desired to attach the bracket 33 toward a bottom end of the seatback 18 proximate the attachment of the seatback 18 to the seat pan 14 for increased support.

Referring again to FIGS. 1 and 2, the shoulder brace assembly 30 may include two laterally spaced rectangular brace arms 40 each shaped into an inverted U-shape top end 68 extending from behind the seatback 18 to the front of the seatback 18 and a U-shaped bottom end 60 attaching to the rear face 34 of the seatback 18.

The brace arms 40 may be shaped to allow the arms 40 to be resiliently biased in a relaxed state to allow the user to move the brace arms 40 forward against increasing resistance. The U-shaped bottom 60 of the brace arms 60 (the "U" is seen when viewed from a side of the chair 10) has an upwardly extending distal end 62 coupled to the rear face 34 of the seatback 18 via the bracket 33 and extending through the curve into an upwardly extending proximal end 64 extending rearward from the distal end 62 and spaced from the seatback 18. The distal end 62 of the U-shaped bottom 60 may provide holes 43, clamps 48 and/or horizontally extending flange 57 with hole 56, as described above, to couple the distal end 62 of the U-shaped bottom 60 to the bracket 33. The distal end 62 and proximal end 64 are connected by a valley 66 defining the curve of the "U" and allowing resilient forward flexure of the proximal end 64 toward the distal 62 and toward the rear face 34 of the seatback 18.

The proximal end 64 of the U-shaped bottom 60 extends to an upwardly extending proximal end 65 of the U-shaped top 68 extending through a curve extending over the upper edge 72 of the seatback 18 and to a downwardly extending distal end 70 extending downwardly along the support face 38 of the seatback 18. The proximal end 65 and distal end 70 are connected by a valley 74 defining the curve of the "U" of the U-shaped top 68 having a width accommodating a width of the upper edge 72 of the seatback 18 and a chest girth of the seated average human user 16 such that the brace arms 40 may extend over the shoulders of the seated average human user 16 and are positionable to engage and extend over the chest and pectoralis minor muscles of the seated average human user 16 in a cantilevered manner.

The valley 74 of the U-shaped top 68 provides a gap 51 between the proximal end 34 and the rear face 34 of the seatback 19 permitting the proximal end 65 to flex toward the rear face 34 of the seatback 18 and allowing the distal end 70 to move in a forward direction. The U-shaped bottom 60 and U-shaped top 68 provide for forward movement of the brace arms 40 to allow the seated average human user 16 to accomplish regular desk activities that require a certain small amount of stretch or reach of the body. However, the rigidity of the arms 40 prevents forward movement of the arms 40 beyond that permitted by movement of the proximal ends 64, 65 toward the rear face 34 of the seatback 18 and thus extended stretches by the seated average human user 16 is not permitted.

The valley 74 of the inverted U-shaped top 68 is substantially wider than the valley 66 of the U-shaped bottom 60 to accommodate the seatback 18 and chest girth of the seated average human user 16. For example, the valley 74 of the U-shaped top 68 may be three or four times wider than the valley 66 of the U-shaped bottom 60.

The respective left and right brace arms 40 are spaced apart to engage the left and right side pectoralis minor muscles of the seated average human user 16 while leaving the centerline 59 of the chest of the seated average human user 16 unrestrained. In this respect, the shoulders of the seated average human user 16 may be pulled back or "arched" by the arms 40 while the centerline 59 of the chest remains in a forward position and thus releasing stress and pressure on the trapezius muscle while stretching the pectoralis minor muscle and opening up the thoracic outlet.

The brace arms 40 extend downwardly along the chest of the seated average human 16 at least 6 inches and as much as 12 inches and approximately halfway down the torso of the seated average human user 16 or halfway down the seatback 18 to provide an upper restraint to an upper half of the torso of the seated average human user 16 but leaving a lower half of the torso of the seated average human user 16 unrestrained.

The brace arms 40 may be additionally cushioned along an inner broad face of the arms 40 to provide padded comfort to the user 16 and the distal end 70 of the brace arms 40 may be inwardly bowed toward the chest of the user 16 to better grip or restrain the chest of the seated average human user 16.

Figure 6:
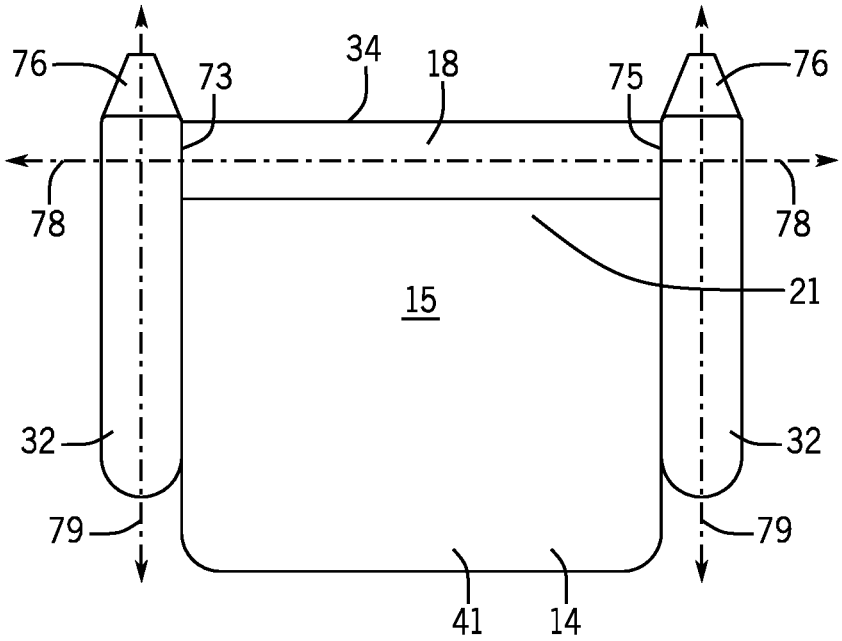
FIG. 6 is a schematic representation of a top plan view of one embodiment of the present invention showing protrusions extending behind the seatback and permitting arms of the average human to stretch behind it.

Referring to FIG. 6, two lateral rearward protrusions 76 may extend rearward from the rear face 34 of the seatback 18 and downwardly with respect to the horizontal plane 39 substantially parallel to the horizontal plane 17 of the seat pan 14 and perpendicular to the rear face 34 of the seatback 18 permitting the seated average human user 16 to rest the back side of their forearms behind the lateral rearward protrusions 76 and stretch their arms behind their backs when in an upward seated position. The lateral rearward protrusions 76 may be rods, bars, knobs, rails or any sort of elongated projection providing a broad surface to support the forearms of the seated average human user 16 when the arms are positioned behind the user's back.

As shown in FIG. 6, the lateral rearward protrusions 76 may be separate from the armrests 32, however, the lateral armrests 32 may also serve as the rearward protrusions 76 as described below with respect to FIG. 7.

Figure 7:
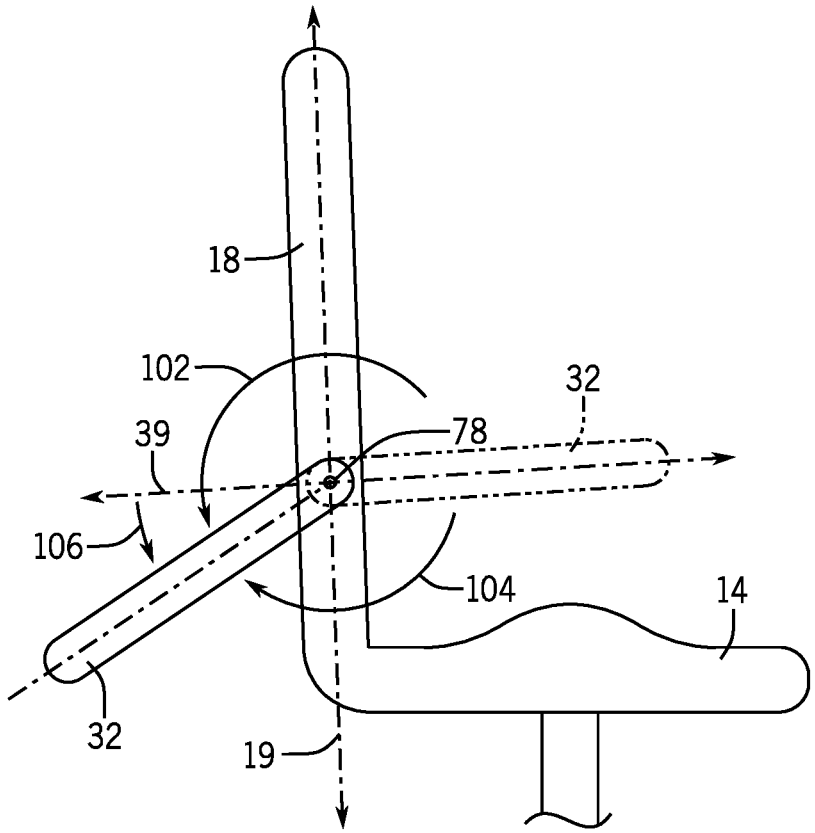
FIG. 7 is a side elevation view of the muscle release office chair of FIG. 1 showing the armrest rotatable to position the armrest rearward and downward of the seatback.

In one embodiment of the present invention, shown in FIG. 7, the lateral armrests 32 may be pivotable about axis 78 extending between left 73 and right 75 lateral sides of the seatback 18 such that the armrests 32 may rotate rearward to a position behind the seatback 18. The pivot axis 78 may permit the armrest 32 to swing rearward along generally vertical planes 79 extending between the front 41 and rear 21 of the seat pan 14. In this embodiment, the armrests 32 may rotate upward along a curve 102 between a forward position extending substantially along horizontal plane 39 and a rearward position extending behind the seatback 18 and at a downward angle 106 at least 20 degrees downward from the horizontal plane 39. The angle of rotation 102 from the forward position may be greater than 180 degrees, for example between 200-250 degrees or about 225 degrees. Alternatively or in addition, the armrests 32 may rotate downward along a curve 104 between forward position extending substantially along horizontal plane 39 and a rearward position behind the seatback 18 and at a downward angle 106 at least 20 degrees downward from the horizontal plane 39. The angle of rotation 104 from the forward position may be less than 180 degrees, for example between 110-160 degrees or about 135 degrees.

The pivot axis 78 may include a detent resisting additional rotation of the armrest 32 such that the armrest 32 remains in a desired position such as at the rearward downward angle 106.

In an alternative embodiment, the pivot axis 78 may be a hinge such that the armrests 32 may rotate laterally along the generally horizontal plane 39. In this embodiment, the armrests 32 may rotate laterally outward from the seat pan 14 from the forward position extending substantially along horizontal plane 39 to a rearward position behind the seatback 18. The pivot axis 78 may further allow the armrests 32 to be tilted at a downward angle 106 at least 20 degrees downward from the horizontal plane 39.

The hinge may be a detent or friction hinge keeping its position at the desired position such as at the rearward downward angle 106.

When the seated average human user 16 places the front of the forearms behind the lateral rearward protrusion 76 or armrest 32 such that the palms of the user's hands face rearward and the upper arm is behind the user's back, stress and pressure is released at the trapezius muscle while the scalene muscles are stretched, opening up the thoracic outlet.

Figure 8:
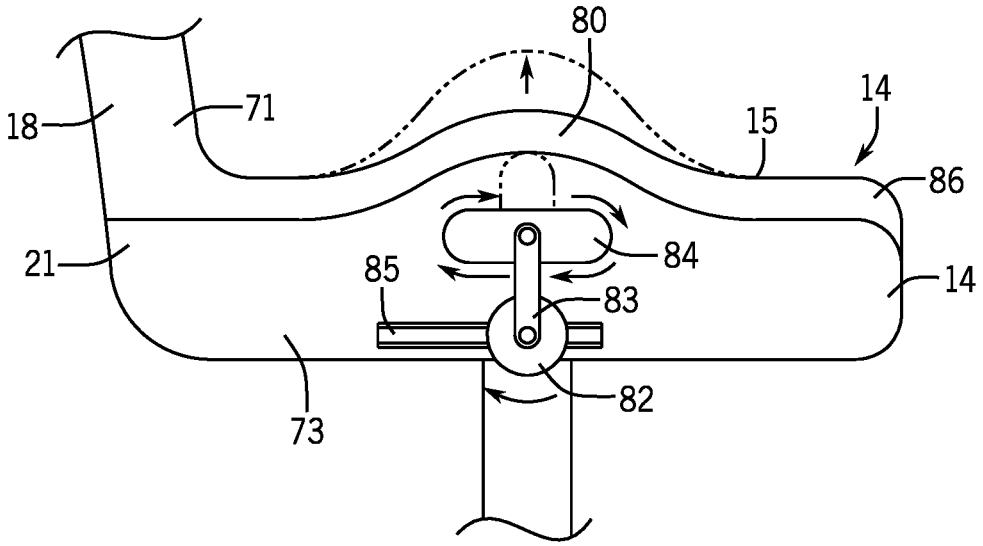
FIG. 8 is an enlarged side elevation view of the muscle release office chair of FIG. 1 showing the seat cushion having a raised midsection with an adjustable height.

Referring to FIGS. 1 and 8, the seat pan 14 may provide a raised semi-cylindrical ridge 80 extending between left 73 and right 75 lateral edges of the seat pan 14 and generally centered between a front 41 and rear 21 of the seat pan 14 so as to be positioned underneath a thigh of the seated average human user 16 and forward of the ischial tuberosity of the seated average human user 16 such that pressure from the seat pan 14 is placed on the user's thigh bone and pressure from the seat pan 14 is released on the ischial tuberosity thus taking pressure off the sacroiliac joints. Moreover, the raised ridge 80 prevents the seated average human user 16 from sitting forward in the seat pan 14, due to the raised ridge 80, encouraging upright sitting and good posture.

A knob 82 is disposed at a side edge of the seat pan 14 providing for adjustment of the height and/or width of the raised ridge 80 to accommodate various sizes or weights of the seated average human user 16. In one embodiment, the knob 82 may be mechanically connected to a shaft or belt 83 turning a cylinder 84 providing the raised ridge 80 and having an oblong section whereby rotation of the cylinder 84 changes the shape of the raised ridge 80. For example, when the knob 82 is rotated such that the major axis of the oblong cross section of the cylinder 84 is vertical, the raised ridge 80 may be at its highest and narrowest position, and when the knob 82 is rotated such that the minor axis of the oblong cross section of the cylinder 84 is vertical, the raised ridge 80 may be at its lowest and broadest position. The raised ridge 80 may have a height of at least 1 inch and as much as 6 inches and a width of at least 1 inch and as much as 6 inches. A layer of cushion material 86 may be positioned between the cylinder 84 and an upper face 15 of the seat pan 14 for comfort to the user 16.

In one embodiment, the position of the raised ridge 80 may be modified to more accurately position the raised ridge 80 underneath the thigh of the seated average human user 16 and forward of the ischial tuberosity. For example, the position of the raised ridge 80 may be modified by sliding the knob 82 along a track 85 extending along the side edge of the seat pan 14 to reposition the cylinder 84 forward and backward in the seat pan 14 as desired by the user's particular body proportions.

It is understood that features of the seat pan 14 may be incorporated into a separate, independent seat cushion, which can be optionally attached or used with the chair 10. In this respect, the independent seat cushion may be used to provide ergonomic support to a standard or non-ergonomic seat pan 14. The independent seat cushion may be used in connection with any type of seat pan or chair such as a car or airplane seat, bench, or on the ground.

It is contemplated that the independent seat cushion incorporates the features of the seat pan 14 described above, for example, including the raised ridge 80 which is adjustable by the knob 82. The independent seat cushion may also have raised ridge 80 with fixed, non-adjustable height whereby varying sizes are available, for example, small, medium and large. The height of the raised ridge 80 may be chosen depending on the height and weight of the user.

The chair 10 provides cooperating features of the shoulder brace assembly 30, lateral rearward protrusion 76, and raised ridge 80 to allow the seated average human user 16 to perform stretches that improve posture and open up the thoracic outlet. In use, the seated average human user 16 places the front of their forearms behind the lateral rearward protrusion 76 with the palms of their hands facing rearward.

The seated average human user 16 also leans their chest forward to allow the brace arms 40 to pull their shoulders back and "arch" their shoulders with their chest remaining in a position. Initial resistance for the forward movement of the chest comes from the forward and backward movement of the seatback 18 with increasing resistance as it moves forward in unison with the seated average human user 16 and brace arms 40. After a certain point, e.g., 15 degrees forward, the resistance may come from the brace arms 40 only.

In these stretching positions, the trapezius muscle is released and the pectoralis minor muscle and scalene muscle are stretched to open the thoracic outlet while seated.

It is understood that the chair 10 may include commonly known adjustments to the chair 10 to assist with additional ergonomic positioning of the seated average human user 16 in the chair 10 by using a lever 88, such as seatback 18 height adjustment, seat pan 14 depth adjustment (by adjusting the seatback 18 and/or the seat pan 14 position with respect to each other), seat pan 14 rotation, seatback 18 tilt tension adjustment, and/or 360 degree swivel of the seat pan 14.

It is understood that the chair 10 may have proof loads such as a seatback 18 strength of at least 150 pounds and a seat pan 14 strength of at least 225 pounds as determined by industry standards.

It is understood that the seat pan 14, seatback 18, and armrest 32 may be exteriorly upholstered in a leather, fabric, or mesh material and padded or stuffed for the comfort of the user 16 as understood in the art.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. An ergonomically configured chair assembly adapted to support a seated average human thereon during muscle release stretches comprising:

a seat having an upwardly exposed seat surface extending along a horizontal plane and adapted to support the seated average human;

an upstanding seatback adjacent the seat extending along a vertical plane with a support face adapted to support a back of the seated average human;

first and second brace arms each having:

an upwardly extending vertical portion attached at a lower end to a corresponding rearward edge of a flexible joint, a front edge of the flexible joint in turn attached to a rear surface of the upstanding seatback, the flexible joint adapted to (a) spring bias an upper end of the upwardly extending vertical portion in a rearward direction away from the rear surface of the seatback to a relaxed position to space the upper end of the upwardly extending vertical portion away from the rear surface of the seatback and (b) bend in a forward direction against an increasing rearward resistance of the spring bias, where bending in the forward direction is configured to move the upper end of the upwardly extending vertical portion toward the rear surface of the seatback forwardly from the relaxed position, and a downwardly U-shaped portion attached to the upper end of the corresponding upwardly extending vertical portion at a rear leg of the U-shaped portion and extending over a top of the seat back to a front leg of the U-shaped portion to pass downwardly over and spaced forward from a front of the seat back adapted to fit over a left or right shoulder of a seated average human thereby restricting forward movement of the seated average human;

wherein each of the first and second brace arms and the attached flexible joints, respectively, form one substantially rigid component.

2. The chair assembly of claim 1 wherein the first and second brace arms are adapted to be downwardly positionable over the chest of the seated average human.

3. The chair assembly of claim 2 wherein the first and second brace arms provide no restraint at a chest centerline of the seated average human.

4. The chair assembly of claim 1 wherein the first and second brace arms are resiliently biased to the relaxed state to allow the seated average human to move the brace arms forward against increasing resistance.

5. The chair assembly of claim 1 wherein the first and second brace arms are adapted to extend downwardly along a torso of the seated average human.

6. The chair assembly of claim 1 wherein the first and second brace arms are upwardly and downwardly adjustable to adjust for a shoulder height of the seated average human.

7. The chair assembly of claim 1 wherein the first and second brace arms are adjustable in left lateral and right lateral directions along the horizontal plane.

8. The chair assembly of claim 7 wherein the first and second brace arms are laterally adjustable to swing along a curved path from a front of the upstanding seatback to a side of the upstanding seatback.

9. The chair assembly of claim 1 wherein the first and second brace arms are padded with a soft material.

10. The chair assembly of claim 1 wherein the seat has a raised portion extending between lateral sides of the seat and wherein a height of the raised portion is adjustable by the seated average human.

11. The chair assembly of claim 1 further comprising an arm restraint positioned rearward with respect to the upstanding seat back and adapted to capture downwardly extending arms of the seated average human having his or her back supported by the upstanding seatback with arms extending behind the arm restraint to stretch the muscles of the seated average human.

12. The chair assembly of claim 11 wherein the arm restraint is at a downwardly extending angle with respect to a second horizontal plane perpendicular to the vertical plane of the seat back.

13. The chair assembly of claim 12 wherein the downwardly extending angle is no less than 20 degrees.

14. The chair assembly of claim 11 wherein the arm restraint is a pair of armrests rotatable at a proximal end about a horizontal axis.

15. The chair assembly of claim 14 wherein the pair of armrests is rotatable about the horizontal axis in an upward or downward direction.

16. A method of performing muscle release stretches comprising the steps of:

providing an ergonomically configured chair assembly adapted to support a seated average human thereon having a seat having an upwardly exposed seat surface extending along a horizontal plane and adapted to support the seated average human;

an upstanding seatback adjacent the seat extending along a vertical plane with a support face adapted to support a back of the seated average human;

first and second one-piece brace arms each having:

an upwardly extending vertical portion attached at a lower end to a corresponding rearward edge of a flexible joint, a front edge of the flexible joint in turn attached to a rear surface of the upstanding seatback, the flexible joint adapted to (a) spring bias an upper end of the upwardly extending vertical portion in a rearward direction away from the rear surface of the seatback to a relaxed position to space the upper end of the upwardly extending vertical portion away from the rear surface of the seatback and (b) bend in a forward direction against an increasing rearward resistance of the spring bias, where bending in the forward direction is configured to move the upper end of the upwardly extending vertical portion toward the rear surface of the seatback forwardly from the relaxed position, and a downwardly U-shaped portion attached to the upper end of corresponding upwardly extending vertical portion at a rear leg of the U-shaped portion and extending over a top of the seat back to a front leg of the U-shaped portion to pass downwardly over and spaced forward from a front of the seat back adapted to fit over left or right shoulder of a seated average human thereby restricting forward movement of the seated average human; and supporting the seated average human on the ergonomically configured chair assembly allowing the first and second brace arms to fit over the left and right shoulders of the seated average human to allow the seated average human to perform muscle release stretches of the chest and shoulders.

* * * * *